US005813580A

United States Patent [19]

Fair

[11] Patent Number: 5,813,580

[45] Date of Patent: Sep. 29, 1998

[54] SOFT-SIDED INFANT CARRIER CONVERTIBLE TO HIP CARRIER

[75] Inventor: Paul F. Fair, Denver, Colo.

[73] Assignee: Lisco, Inc., Tampa, Fla.

[21] Appl. No.: 738,327

[22] Filed: Oct. 25, 1996

[51] Int. Cl.[6] ..... A45F 3/04

[52] U.S. Cl. ..... 224/160; 200/159; 200/579

[58] Field of Search ..... 224/160, 159, 224/579, 580

[56] References Cited

U.S. PATENT DOCUMENTS

| | | | |
|---|---|---|---|
| D. 132,469 | 5/1942 | Murphy . | |
| D. 253,558 | 12/1979 | Carter . | |
| D. 277,811 | 3/1985 | Moore . | |
| D. 324,607 | 3/1992 | Nelson . | |
| D. 332,175 | 1/1993 | Beplate . | |
| D. 357,800 | 5/1995 | Roan et al. | D3/214 |
| D. 370,996 | 6/1996 | Shimura et al. | D3/214 |
| 2,376,657 | 5/1945 | Chamberlain . | |
| 2,411,331 | 11/1946 | Nettleship . | |
| 2,628,358 | 2/1953 | Neils | 2/69.5 |
| 3,481,517 | 12/1969 | Aukerman . | |
| 4,166,558 | 9/1979 | Schroeder | 224/158 |
| 4,333,591 | 6/1982 | Case | 224/160 |
| 4,402,440 | 9/1983 | Purtzer et al. | 224/160 |
| 4,428,514 | 1/1984 | Elf | 224/579 |
| 4,434,920 | 3/1984 | Moore | 224/160 |
| 4,436,233 | 3/1984 | Hill et al. | 224/159 |
| 4,467,945 | 8/1984 | Schaapveld | 224/160 |
| 4,717,056 | 1/1988 | Carmichael | 224/158 |
| 4,986,458 | 1/1991 | Linday | 224/160 |
| 5,011,057 | 4/1991 | Perruzza et al. | 224/158 |
| 5,020,709 | 6/1991 | Hoaglan | 224/151 |
| 5,071,047 | 12/1991 | Cordisco | 224/158 |
| 5,178,309 | 1/1993 | Bicheler et al. | 224/160 X |
| 5,205,450 | 4/1993 | Derosier | 224/161 |
| 5,222,641 | 6/1993 | Medeiros, Jr. | 224/161 |
| 5,246,152 | 9/1993 | Dotseth | 224/159 |
| 5,333,769 | 8/1994 | Skroski | 224/158 |
| 5,361,952 | 11/1994 | Gold | 224/159 |
| 5,441,186 | 8/1995 | Halligan | 224/159 |
| 5,454,498 | 10/1995 | Dunn et al. | 224/160 |
| 5,490,620 | 2/1996 | Bergqvist | 224/160 |
| 5,492,256 | 2/1996 | Ive | 224/159 |
| 5,522,528 | 6/1996 | Petricola | 224/160 |
| 5,692,655 | 12/1997 | Fair et al. | 224/160 |

*Primary Examiner*—Renee S. Luebke

*Attorney, Agent, or Firm*—Robert G. Crouch; Holland & Hart LLP

[57] ABSTRACT

A frameless infant carrier which converts from a front carrier to a hip carrier. The carrier includes a pouch for containing the infant, a waistbelt for adjustably connecting the pouch about the wearer's waist, a pair of shoulder straps attached to the pouch for supporting the infant on the shoulders of the wearer, and a pair of infant support straps connected between the front panel of the pouch and the shoulder straps. The infant support straps are adjustable to provide support for the upper portion of the pouch, and to draw the infant securely against the wearer. The carrier converts between alternate carrying positions by disconnecting each of the shoulder straps from the waistbelt, connecting the free ends of the shoulder straps to the infant support straps, slipping an arm of the wearer under a shoulder strap so that the shoulder strap slips off the shoulder of the wearer, and sliding the pouch laterally around the body of the wearer.

8 Claims, 3 Drawing Sheets

SOFT-SIDED INFANT CARRIER CONVERTIBLE TO HIP CARRIER

The present invention relates to an improved design for a soft-sided infant carrier and, more particularly, to an infant carrier which converts from a front carrier to a hip carrier.

BACKGROUND OF THE INVENTION

Shoulder-supported infant carriers are well known, including a plethora of designs and styles which have been used for both front carriers and back carriers. Such infant carriers offer "hands free" operation, and allow the adult wearer to carry the infant while performing other activities. The two most popular infant carriers are the frame-type carriers, which typically support the infant on the back of the wearer, and the frameless or soft-sided carriers, which support the infant on the front, back or hip of the wearer.

One disadvantage common to almost all carriers is that it is difficult, if not impossible, to convert from one carrying position to another, particularly while the carrier is in use with an infant. Certain infant carriers, however, have been designed to assume multiple infant-carrying positions without removing the child, but with varying degrees of success. One type of carrier designed to convert from a front carrier to a hip carrier includes a pair of shoulder straps, a pouch, and a girth strap. To switch carrying positions, a shoulder strap is simply slipped over the shoulder, then the entire carrier is slid around the wearer's body. Although this process is generally convenient and uncomplicated, the carrier lacks side panels or other support structures and the infant is supported by only one strap during the transition, and thus the child's safety is of concern. This design also suffers from limited carrying positions (the infant must face inwardly toward the wearer at all times), and inadequate support for the infant (the infant's back rest is supported only by the shoulder straps). Other common drawbacks associated with existing carriers include uncomfortable harness arrangements and unbalanced weight distribution, both of which cause fatigue and/or discomfort to the wearer.

It is against this background and the desire to solve the problems of the prior art that the present invention has been developed.

SUMMARY OF THE INVENTION

Accordingly, it is an object of the present invention to provide a soft-sided infant carrier which is capable of conveniently assuming various carrying positions.

It is also an object of the present invention to provide a soft-sided infant carrier which is capable of converting from a front carrier to a hip carrier while the infant remains safely and securely seated in the carrier.

It is further an object of the present invention to provide an infant carrier having the appropriate configuration and weight distribution arrangement for optimum comfort of both the infant and the adult wearer.

Additional objects, advantages and novel features of this invention shall be set forth in part in the description that follows, and in part will become apparent to those skilled in the art upon examination of the following specification or may be learned by the practice of the invention. The objects and advantages of the invention may be realized and attained by means of the instrumentalities, combinations, and methods particularly pointed out in the appended claims.

To achieve the foregoing and other objects and in accordance with the purposes of the present invention, as embodied and broadly described therein, the present invention is directed to a frameless infant carrier for carrying and supporting an infant on the body of an adult-sized wearer. The carrier includes an infant support adapted for receiving an infant, a waistbelt for adjustably connecting the infant support about the wearer's waist, a pair of shoulder straps adapted for encircling the shoulders of the wearer, and a pair of infant support straps connected between an upper region of the front panel and the shoulder straps, the straps being adjustable to support the upper portion of the infant support, and to draw the infant snug against the wearer.

The infant support may include a middle support panel disposed between the front and back panels, wherein the middle support panel is adapted for converting the infant carrier from a rearwardly facing carrier to a forward-facing carrier. The support may include first and second side panels transversely disposed between the front and back panels, wherein the middle panel has first and second opposed edges, the opposed edges being connected at a substantially central position on each of the first and second side panels. The support may be connected to the shoulder straps in a manner which allows the infant support to convert between a front-carrying position and a hip-carrying position. Each of the second ends of the shoulder straps may be connectible to the waistbelt by a first releasable fastener, the first fastener having complementary first and second buckle members, and each of the second ends may be connectible alternatively to the infant support straps by a second releasable fastener, the second fastener having complementary first and second buckle members. The second ends of the shoulder straps may be connected to the first buckle member of the first releasable fastener in the front-carrying position and to the first buckle member of the second releasable fastener in a hip-carrying position. Each of the first releasable fasteners may include a female member mounted on the second end of the shoulder strap and a male mating member on the waistbelt, wherein each of the second releasable fasteners may comprise a male member mounted on the infant support strap and a female mating member on the shoulder strap. The shoulder straps may be arranged to extend both over the same shoulder of the wearer when the infant support is oriented in a hip position, the same shoulder being the opposite shoulder from the side of the wearer on which the infant support is oriented. The shoulder straps may be of adjustable length. The support may be shaped and connected to the shoulder straps in an orientation for carrying the infant in a substantially vertical position. The shoulder straps may include a detachable fastener for removably affixing a bib thereto. The support may include a fabric pouch.

The present invention is also directed to a method for converting a frameless infant carrier from a front-carrying position to a hip-carrying position while in use on the body of an adult-sized wearer, the carrier including a pouch having a pair of shoulder straps, a pair of infant support straps, and a waistbelt attached thereto. The method includes the steps of disconnecting each of the shoulder straps from the waistbelt, connecting the free ends of the shoulder straps to the infant support straps, slipping an arm of the wearer under a shoulder strap so that the shoulder strap slips off the shoulder of the wearer, and sliding the pouch laterally around the body of the wearer.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE PREFERRED EMBODIMENTS

Figure 1:
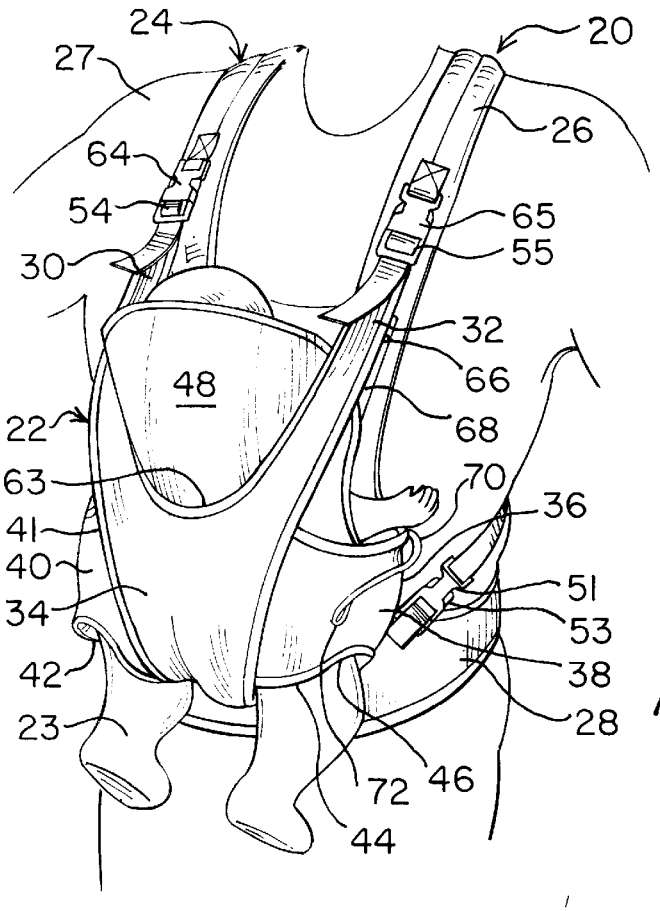
FIG. 1 is a perspective view of a convertible soft-sided infant carrier of the present invention, shown in a front-carrying position on a wearer, with an infant in the facing-in position.

A convertible soft-sided infant carrier 20 (FIG. 1) includes a fabric pouch 22 for carrying an infant 23, a pair of shoulder straps 24 and 26 attached to the pouch 22 for supporting the pouch 22 and infant 23 on the shoulders of a wearer 27, a waistbelt 28 for adjustably connecting the fabric pouch 22 about the waist of the wearer 27, and a pair of adjustable infant support straps 30 and 32 connected between the pouch 22 and the shoulder straps 24 and 26 for supporting and pulling the upper portion of the pouch 22 taut against the wearer 27.

The pouch 22 includes a front support panel 34, a back support panel 36, and a pair of side panels 38 and 40 which extend laterally of both sides of the back support panel 36. The front support panel 34 is positioned outwardly away from the wearer 27 and the back support panel 36 is disposed between the infant 23 and the wearer 27 when the carrier 20 is in use on the wearer 27, as illustrated in the drawings herein. The side panels 38 and 40 are shaped so that when stitched to front support panel 34 along side seams 41, a pair of leg openings 42 and 44 are defined thereunder. Preferably, each leg opening 42 and 44 and front support panel 34 are bordered by a padded, fabric binding 46 stitched thereto for comfort, reinforcement, and durability purposes.

The pouch 22 includes a middle panel 48 for converting the infant carrier 20 from a rearwardly facing carrier (FIG. 1) to a forward-facing carrier (FIG. 7), and vice versa. The middle panel 48 is stitched at opposite ends thereof to the side panels 38 and 40, preferably at a substantially central position on each of the side panels. The middle panel 48 is comprised of a semi-rigid polyboard material so as to stiffen and limit the bendable nature of the otherwise soft-sided materials of the pouch 22. When an infant 23 is placed in the carrier 20, the middle panel 48 becomes curved in a shape which is a portion of an elongated cylinder (the longitudinal axis of the cylinder being parallel to the longitudinal axis of the carrier 20 and the infant 23 therein). The middle panel 48 has the characteristic that when curved in this fashion (i.e., about a particular axis), it is very difficult to simultaneously curve the panel about a second orthogonal axis. Thus, it is very unlikely that the panel would bend or curve backward to allow the infant 23 to pivot away from the body of the wearer 27 when the infant 23 is seated within the carrier 20.

Figure 7:
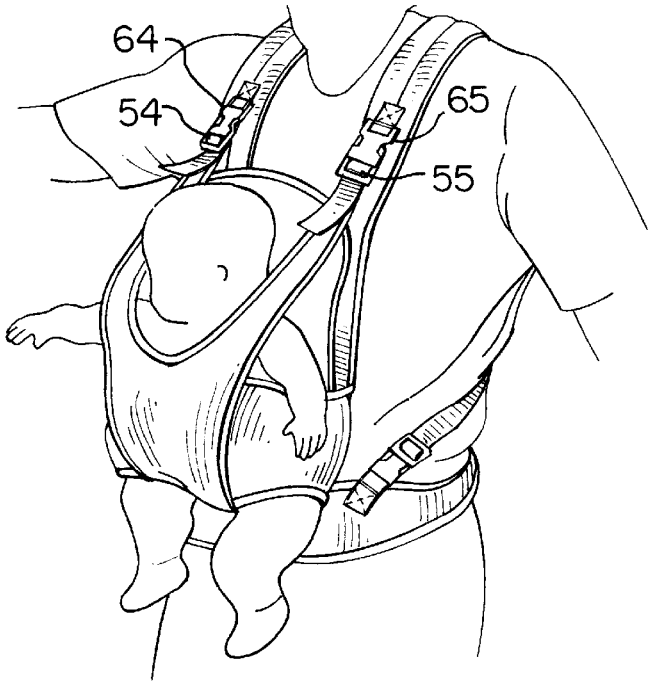
FIG. 7 is a perspective view of the infant carrier of FIG. 1, shown with the infant in the facing-out position.

To position the infant 23 in an inwardly facing position toward the wearer 27, as illustrated in FIG. 1, the middle panel 48 is directed forward into juxtaposition with the front support panel 34. The infant 23 is then seated in the pouch 22 in such a manner that the back support panel 36 supports the front torso of the infant 23, and the middle panel 48 supports and partially encircles the buttock, back, neck and head areas of infant 23. Alternatively, to position the infant 23 in an outwardly facing position away from the wearer 27, as illustrated in FIG. 7, the middle panel 48 is bent backward into juxtaposition with the back support panel 36. Thus, in the outward-facing position, the front support panel 34 supports the front torso of the infant 23, and the middle panel 48 supports the back side of the infant 23.

Figure 2:
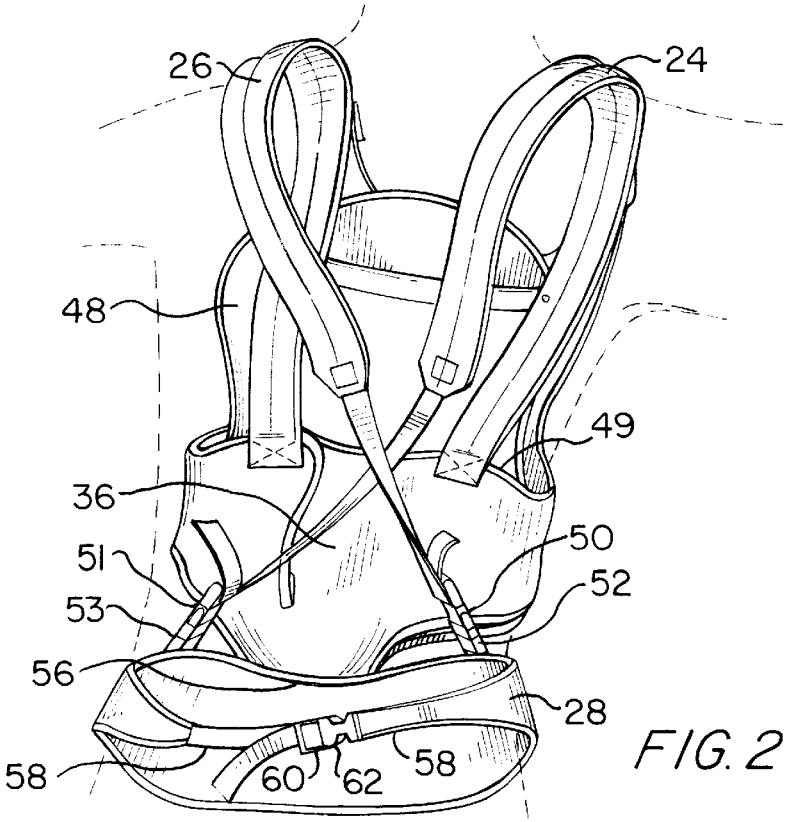
FIG. 2 is a rear view of the convertible soft-sided infant carrier of FIG. 1, shown without an infant in the carrier and with the wearer of the carrier illustrated in phantom.

Referring now to FIG. 2, the shoulder straps 24 and 26 are stitched at the upper edge 49 of the back support panel 36 at spaced-apart, horizontally-aligned positions. The shoulder straps 24 and 26, being attached along one end to the back support panel 36 of the pouch 22, are attached at an opposite end to either the waistbelt 28 (FIG. 2) or the infant support straps 30 and 32 (FIG. 6) via buckle members 50 and 51 on each shoulder strap 24 and 26. The buckle members 50 and 51 engage with complementary buckle members 52 and 53, respectively, on the waistbelt 28 when the pouch 22 is oriented in a frontal position on the body of the wearer 27, as shown in FIG. 1. Alternatively, as discussed in more detail below and as best seen in FIGS. 3–6, buckle members 50 and 51 engage with complementary buckle members 54 and 55, respectively, on the infant support straps 30 and 32 when the pouch 22 is oriented in a hip-carrying position on the body of the wearer 27. As is apparent from the drawings and description herein, the carrier 20 is symmetrically designed such that the shoulder straps 24 and 26, infant support straps 30 and 32, buckle members 50 and 51, buckle members 52 and 53, and buckle members 54 and 55 refer respectively to identical structures on opposing sides of the pouch 22.

The shoulder straps 24 and 26 are adjustable in their effective length by manipulating each strap 24 and 26 relative to buckles 50 and 51, respectively, located at an end of each strap. By manipulating these straps to effectively lengthen or shorten the shoulder belts, the shoulder belts can be adjusted relative to the torso size of the wearer 27.

As best seen in FIG. 2, the infant carrier 20 includes an adjustable waistbelt 28 for adjustably connecting the pouch 22 about the waist of the wearer 27. The waistbelt 28 is stitched to a lower region 56 of back support panel 36. The waistbelt 28 includes first and second end portions 58 each having complementary buckle members 60 and 62 adjustably positioned proximate opposing ends thereof. As illustrated in FIG. 2, the waistbelt 28 is fastened about the waist region of the wearer 27 by engaging the complementary buckle members 60 and 62. The operational circumference of the waistbelt 28 may be adjusted by manipulating the waistbelt 28 relative to the buckle members 60 and 62. By manipulating the waistbelt to effectively lengthen or shorten it, the waistbelt 28 can be adjusted relative to the waist size of the wearer 27.

In order to further support the infant 23 and the pouch 22, a pair of adjustable infant support straps 30 and 32 are formed from the upper edge of the front support panel 34 of the pouch 22, as illustrated in the exemplified embodiments hereof. Alternatively, straps 30 and 32 may be stitched along one end to the upper edge 63 of the front support panel 34 at spaced-apart, horizontally-aligned positions. In the exemplified embodiments, the infant support straps 30 and 32 terminate at male ends of buckles 54 and 55 which matingly engage with the female end of buckles 64 and 65, respectively, on shoulder straps 24 and 26 when the pouch 22 is oriented in a frontal position on the body of the wearer 27, as shown in FIG. 1. Alternatively, as discussed below in reference to FIGS. 3–6, the buckles 54 and 55 matingly engage with the female end of buckles 50 and 51, respectively, at the terminal end of shoulder straps 24 and 26 when the pouch 22 is oriented in a hip-carrying position.

The infant support straps 30 and 32 are adjustable in their effective length by manipulating each strap 30 and 32 relative to buckles 54 and 55, respectively, located at an end of each strap. By manipulating these straps, the support straps 30 and 32 can be adjusted to provide additional support for the pouch 22, and to draw the upper portion of the pouch taut against the wearer 27.

Figure 5:
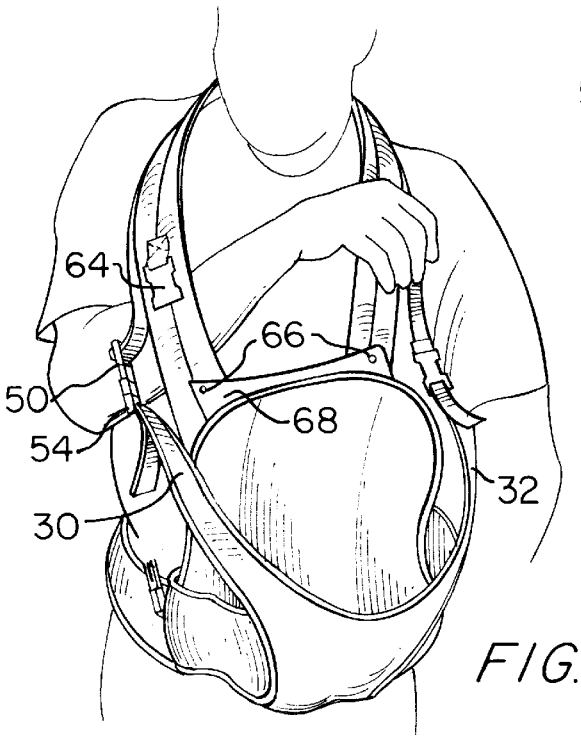
FIG. 5 is a perspective view similar to FIGS. 3 and 4, showing an arm of the wearer being slid under a shoulder strap.

As best seen in FIGS. 1 and 5, the shoulder straps 24 and 26 may include a pair of snap fasteners 66 for securing a variety of bibs, towels or the like to the infant carrier 20 of the present invention. For example, a bib 68 may be extended between the snap fasteners 66 to protect the wearer's clothing from infant vomit or drool.

Figure 6:
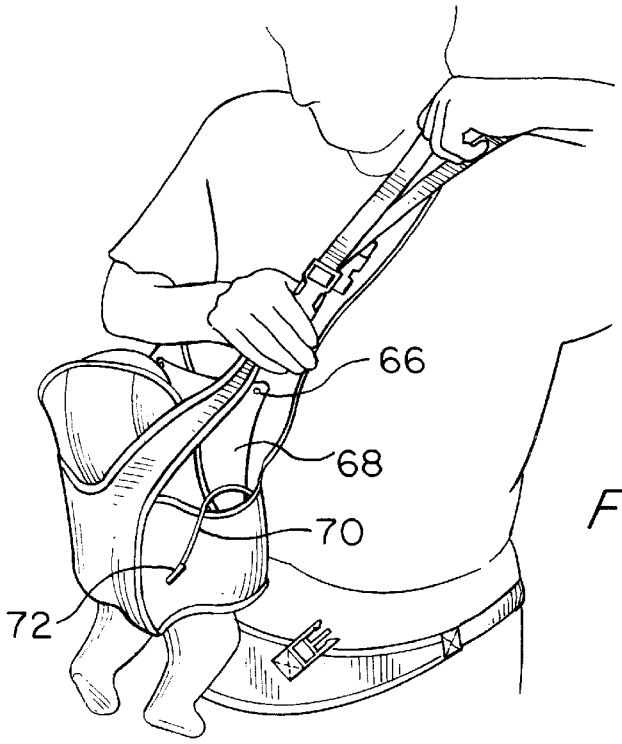
FIG. 6 is a perspective view of the infant carrier of FIG. 1, shown in a hip-carrying position.

As best seen in FIGS. 1 and 6, the carrier 20 may include a strap 70 which terminates in a fastener 72, such as a hook and loop fastener sold under the trademark VELCRO or the like, for securing a pacifier to the infant carrier 20. Preferably, the strap 70 is stitched to either the back support panel 36 or a side panel 38 or 40.

Figure 3:
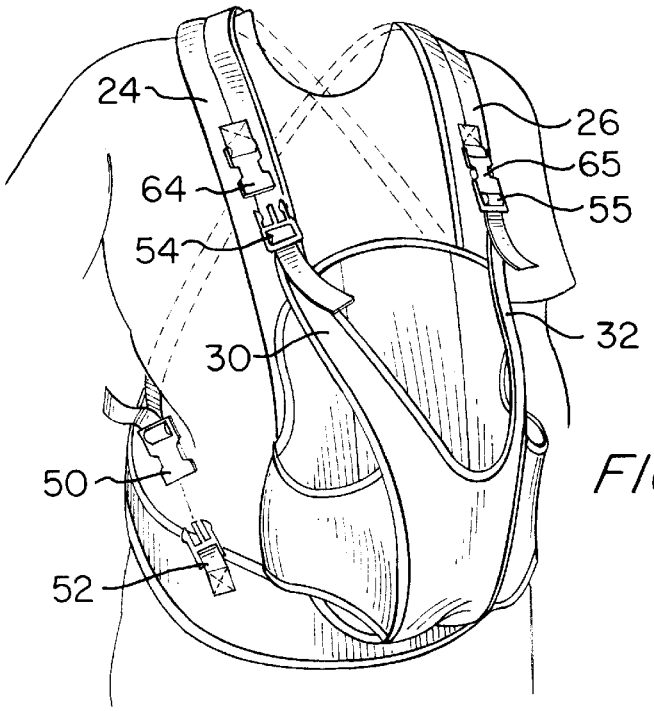
FIG. 3 is a perspective view of the infant carrier of FIG. 1 during the initial stages of converting from a front-carrying position to a hip-carrying position, showing a shoulder strap disconnected from the waistbelt and the corresponding infant support strap disconnected from the shoulder strap.
Figure 4:
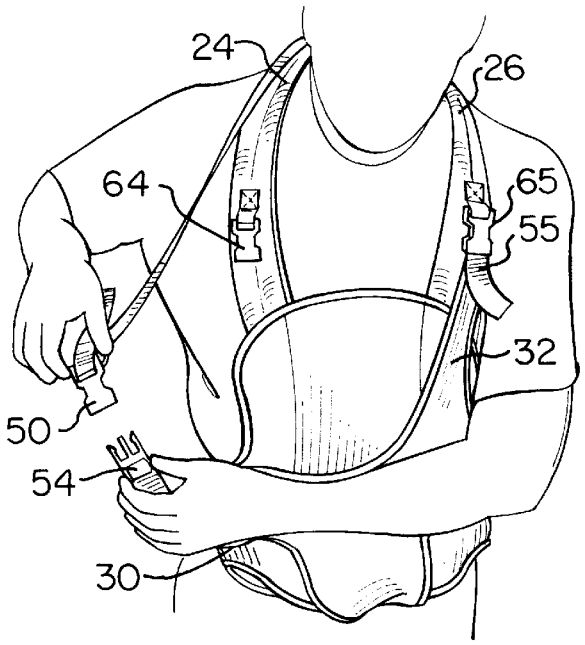
FIG. 4 is a perspective view similar to FIG. 3, showing the shoulder strap being connected to the corresponding infant support strap.

FIGS. 3 through 6 illustrate the method of the present invention for converting the infant carrier 20 from a front-carrying position to a hip-carrying position. As shown in FIG. 3, shoulder strap 26 is disconnected from the waistbelt 28 by disengaging buckles 50 and 52. Similarly, the infant support strap 30 is disconnected from shoulder strap 24 by disengaging buckles 54 and 64. The free end of shoulder strap 26 is then lifted over the shoulder of the wearer 27 to bring the female end of buckle 50 in mating contact with the male end of buckle 54 on the infant support strap 30, as shown in FIG. 4. The process is then repeated with shoulder strap 24 and infant support strap 32 to connect buckles 51 and 55 thereon. To convert from a front-carrying position to a right hip-carrying position, the wearer 27 slips his or her right arm under the shoulder strap 24, as shown in FIG. 5, so that the right shoulder strap 24 slips off the right shoulder of the wearer. To complete the conversion, the pouch 22 is slid laterally around the body of the wearer 27 from left to right with respect to the wearer, as shown in FIG. 6. While FIGS. 3–6 and the description herein exemplify the conversion of the infant carrier 20 to the right hip position, it will be appreciated that a mirror image can equally readily be adopted whereby the infant carrier 20 is transferred from the frontal position to a left hip-carrying position.

A significant advantage of the present invention is that the infant carrier 20 can be safely converted between the frontal and side positions while an infant is supported within the pouch 22. As is apparent from the description and the drawings herein, the carrier 20 comprises multiple support straps which are rearranged in such a manner that the pouch 22 remains well supported during conversion between carrying positions. Thus, although FIGS. 3–5 illustrate this process without an infant 23, it will be understood that the conversion process can be safely practiced without first removing the infant 23 from the pouch 22.

In the carrying positions shown in FIGS. 1, 6 and 7, the infant 23 is seated and supported facing the chest of the wearer 27 (FIGS. 1 and 6) or outward away from the wearer 27 (FIG. 7), with the legs of the infant 23 extending downwardly through leg openings 42 and 44, and bending comfortably at the knee. In either of these positions, the weight of the infant 23 is primarily distributed about the hips of the wearer 27, while the pouch 22, infant support straps 30 and 32, and shoulder straps 24 and 26 afford support without transmitting significant bearing weight to the shoulders of the wearer 27. The infant carrier 22 of the present invention thus affords substantial comfort to both the infant 23 and adult wearer 27.

Another significant advantage of the present invention is the additional support provided by the infant support straps 30 and 32. Unlike existing infant carriers, which typically support the infant exclusively by means of shoulder straps and/or side straps, the carrier of the present invention includes supplemental infant support straps 30 and 32. The infant support straps 30 and 32 extend upwardly from an upper region of the front support panel 34, over the infant's shoulders, and attach to a front section of the shoulder straps 24 and 26, thus providing an additional point of attachment for the pouch 22 and a further means of support, particularly for the upper portion of the carrier 20. Moreover, and very importantly, the infant support straps 30 and 32 are adjustable, thus providing a mechanism for drawing the infant 23 and the upper region of the infant carrier 20 snug against the wearer 27. The carrier of the present invention thus affords better support and more security for the infant 23 than existing designs.

It can be appreciated that there are a variety of means for connecting the pouch 22 to the shoulder straps 24 and 26, infant support straps 30 and 32 and waistbelt 28. As can be appreciated, buckles, snaps and seams can be interchangeably substituted as well as such other equivalents as hook and loop fasteners sold under the trademark VELCRO, buttons, etc.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

It is claimed:

1. A method for converting a frameless infant carrier from a first position to a second position while in use on a body of an adult-sized wearer, the carrier including a pouch having a pair of shoulder straps, a pair of infant support straps, and a waistbelt attached thereto, the method comprising the steps of:

(a) disconnecting a first shoulder strap from the waistbelt;

(b) connecting the first shoulder strap to a corresponding first infant support strap;

(c) disconnecting a second shoulder strap from the waistbelt;

(d) connecting the second shoulder strap to a corresponding second infant support strap;

(e) slipping a first arm of the wearer under the first shoulder strap so that the first shoulder strap slips off a corresponding first shoulder of the wearer; and (f) sliding the pouch laterally around the body of the wearer from the first position to the second position.

2. A method as defined in claim 1, wherein steps (a) through (f) are carried out in sequence, and wherein the pouch is slid laterally from front to side around the body of the wearer so that the infant carrier converts from a frontal position to a hip-carrying position.

3. A method as defined in claim 1, wherein steps (a) through (f) are carried out in a reverse sequence so that the infant carrier converts from a side position to a frontal position.

4. A method as defined in claim 1, wherein steps (a) and (b) are carried out after steps (c) and (d).

5. A method as defined in claim 1, wherein after step (b) has been performed, the connected first shoulder strap and first infant support strap form a loop from the carrier around a neck of the wearer and back to the carrier, and further wherein the first arm of the wearer can be selectively placed into or outside of the loop.

6. A method as defined in claim 1, wherein the first shoulder strap is connected at a first end to the pouch and a second end is selectively connected to either the waistbelt or to a first end of the first infant support strap.

7. A method as defined in claim 6, wherein the first infant support strap includes a second end that is connected to the pouch, and further wherein the first end of the first infant support strap is selectively connected to either the second end of the first shoulder strap or to a portion of the second shoulder strap on a front side of the wearer, proximate to a connection of the second shoulder strap to the pouch.

8. A method as defined in claim 7, wherein the shoulder straps are connected to the pouch on a side of the pouch facing the wearer and the infant support straps are connected to the pouch on an opposite side of the pouch facing away from the wearer.

* * * * *